US005829278A

United States Patent [19]

Koo

[11] Patent Number: 5,829,278

[45] Date of Patent: Nov. 3, 1998

[54] AUTOMATIC WET TOWEL SUPPLYING APPARATUS

[76] Inventor: Ja Yoon Koo, 1505-1 Joong-Dong, Saman Regency 3rd Apt. 401, Haeundae-ku, Pusan, Rep. of Korea

[21] Appl. No.: 866,246

[22] Filed: Jun. 5, 1997

[30] Foreign Application Priority Data

Dec. 28, 1996 [JP] Japan ..... 8-358460

[51] Int. Cl.[6] ..... D06B 1/02

[52] U.S. Cl. ..... 68/205 R; 118/325; 134/122 R; 134/201; 222/180

[58] Field of Search ..... 134/64 R, 122 R, 134/201; 68/202, 205 R; 118/324, 325; 222/180; 8/151

[56] References Cited

U.S. PATENT DOCUMENTS 3,707,945 1/1973 Boone .
3,749,313 7/1973 Weitmann .
4,620,502 11/1986 Kimble .
4,667,846 5/1987 Marceau .
4,964,543 10/1990 Scheiber ..... 222/180
5,375,616 12/1994 Chen ..... 68/205 R
5,375,920 12/1994 Cassia .
5,435,465 7/1995 El-Amin .
5,443,084 8/1995 Saleur ..... 134/122 R
5,672,206 9/1997 Gorman ..... 118/325
5,697,577 12/1997 Ogden .

*Primary Examiner*—Frankie L. Stinson
*Attorney, Agent, or Firm*—Birch, Stewart, Kolasch & Birch, LLP

[57] ABSTRACT

An automatic wet towel supplying device includes a cutting member for automatically supplying and cutting a dry cotton cloth, a spraying member for providing uniform dampening moisture to produce a wet towel, and a winding member for winding the wet towel in a rolled state while homogenizing the moisture content in the wet towel.

9 Claims, 4 Drawing Sheets

AUTOMATIC WET TOWEL SUPPLYING APPARATUS

BACKGROUND OF THE INVENTION

1. Field of the Invention

The present invention relates to an improved automatic wet towel supplying apparatus and more particularly, to an apparatus including a cutting unit for automatically supplying a dry cotton cloth and cutting the dry cotton cloth to a certain length; a spraying unit for uniformly dampening the cut towel with cold or hot water; a winding unit for automatically cutting the wet towel in a rolled state; and automatically removing surplus moisture from the wet towel while homogenizing the remaining moisture content of the wet towel.

2. Description of Related Art

Various types of automatic wet towel supplying apparatuses are known in the art. Specifically, in the restaurant, a meal guest receives a wet towel before eating meal. At this time, the towel is dampened with moisture to easily clean up the hands of the meal guest since the hands of the meal guest are typically dirty and may be contaminated with sweat. Also, during periods of warm weather, the meal guest uses the wet towel to cool his hands or face.

However, conventional wet towels are manufactured by the following steps. Initially, the towel is washed and secondly, the cleaned towels are packed in vinyl packages which permits the towels to become easily contaminated with a colon bacillus. Therefore, conventional wet towels suffer from a number of sanitary problems.

Recently, in order to solve the problems of conventional wet towels, a disposable wet towel supplying apparatus was developed. The disposable wet towel supplying apparatus comprises a casing containing a cotton cloth to a rolled state, a cutting member for cutting the cotton cloth in a certain length if necessary, a spraying member for spraying moisture to the cotton cloth, and a cutting member for cutting the wet cotton cloth as a wet towel in a rolled state.

However, the disposable wet towel supplying apparatus suffers from a number of problems. For example, since the cutting member includes a fixed cutter and a moving cutter, where both cutters are disposed in horizontal parallel positions for cutting the cotton cloth, the conventional disposable wet towel supplying apparatus cannot cut precisely and can shorten the life of the motor for the fixed and moving cutters since uncut cotton cloth jams between the fixed and moving cutters. While the disposable wet towel supplying apparatus includes an approach sensor, the sensor does not have an accurate sensing function which in turn permits the insertion of strange material in the sensing area.

Also, the conventional disposable wet towel supplying apparatus includes a spraying member having a water holding tank for holding water. If contaminates, such as colon bacillus, are in the water of the water holding tank, there is no sterilization method to sanitize the water or towel. In a conventional disposable wet towel supplying apparatus, there is no selective supplying member to permit the selection of supplying cold or hot water to the dry towel. In the conventional apparatus, the spraying member collects scaled debris frequently, so that it is inconvenient to clean the apparatus since the entire apparatus has to be disassembled in order to remove the scaled debris in the spraying member.

The conventional disposal wet towel supplying apparatus usually supplies wet towels to the meal guests after dampening the dry towels. The wet towels typically have surplus moisture and are not uniformly moisturized. Sometimes, the meal guests must squeeze out water from the towels.

SUMMARY OF THE INVENTION

Accordingly, it is an object of the present invention to provide an automatic wet towel supplying apparatus which eliminates the above problems encountered with the conventional the towel supplying apparatus.

Another object of the present invention is to provide an improved automatic wet towel supplying apparatus which includes a cutting unit for precisely cutting a dry towel, a spraying unit for selectively and uniformly spraying moisture to the dry towel, and a winding unit for automatically winding the towel in a rolled state while homogenizing the moisture content in the wet towel.

Briefly described, the present invention is directly related to an automatic wet towel supplying device which includes a cutting member for automatically supplying and cutting a dry cotton cloth, a spraying member for uniformly distributing moisture to a dry towel, and a winding member for winding a wet towel in a roll state while homogenizing the moisture content in the wet towel.

A further object of the present invention is to provide an apparatus for automatically supplying a wet towel, including a sensing member for effectively controlling a cutting member in accordance with the position of the dry cotton cloth;

the cutting member has a rotary cutter rotated by a fixed motor and a driving motor; a plurality of cutters for exactly cutting the dry cotton cloth and for providing movement of the cloth in a momentary stopping manner for loading the cotton cloth one at a time so as to prevent the cutters from becoming intertwined with the cotton cloth; a microswitch for controlling rotation of the rotary cutter; a spraying member which eliminates the colon bacillus in the water of the water holding tank; a selective supplying member for selectively supplying cold water or hot water, whereby the moisture content in a rolled wet towel is homogenized for a uniform distribution.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
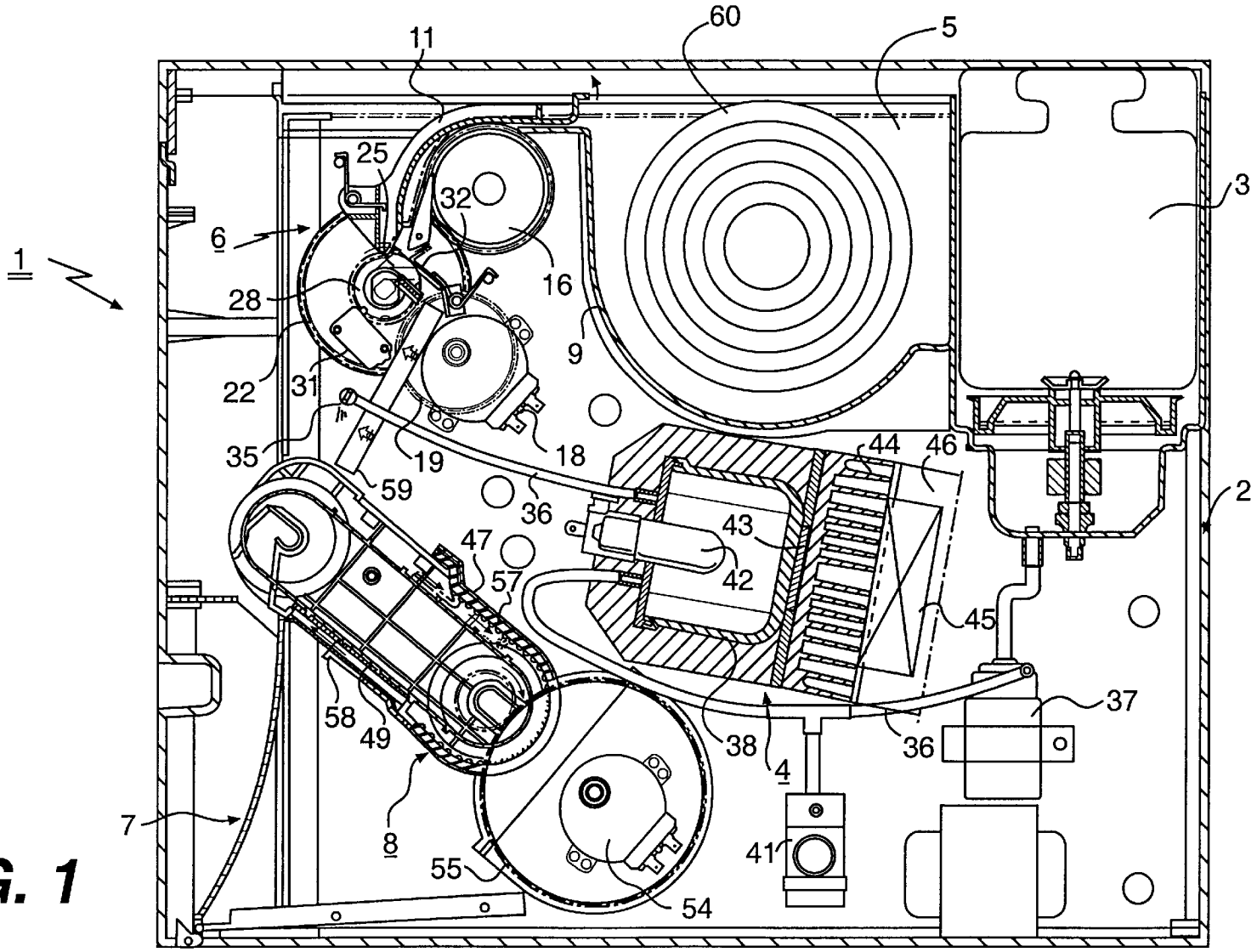
FIG. 1 is a top view of an automatic wet towel supplying apparatus according to the present invention containing cut away portions in order to illustrate the construction of the apparatus of the present invention.

Referring now in detail to the drawings for the purpose of illustrating preferred embodiments of the present invention, the automatic wet towel supplying apparatus 1 as shown in FIG. 1, includes a housing 2, a water holding tank 3 disposed on the rear top of the housing 2, a spraying member 4 communicating with the water holding tank 3 and disposed in the center of the housing 2, a dry cotton cloth chamber 5 for holding a roll 60' of dry cotton cloth 60, a cutting member 6 for cutting the dry cotton cloth 60 of the roll 60', and a wet towel winding member 8 for rolling the wet towel 60*a*, controlling the moisture degree of the wet towel 60*a* and discharging the wet towel 60*a* to an outlet 7.

Figure 2:
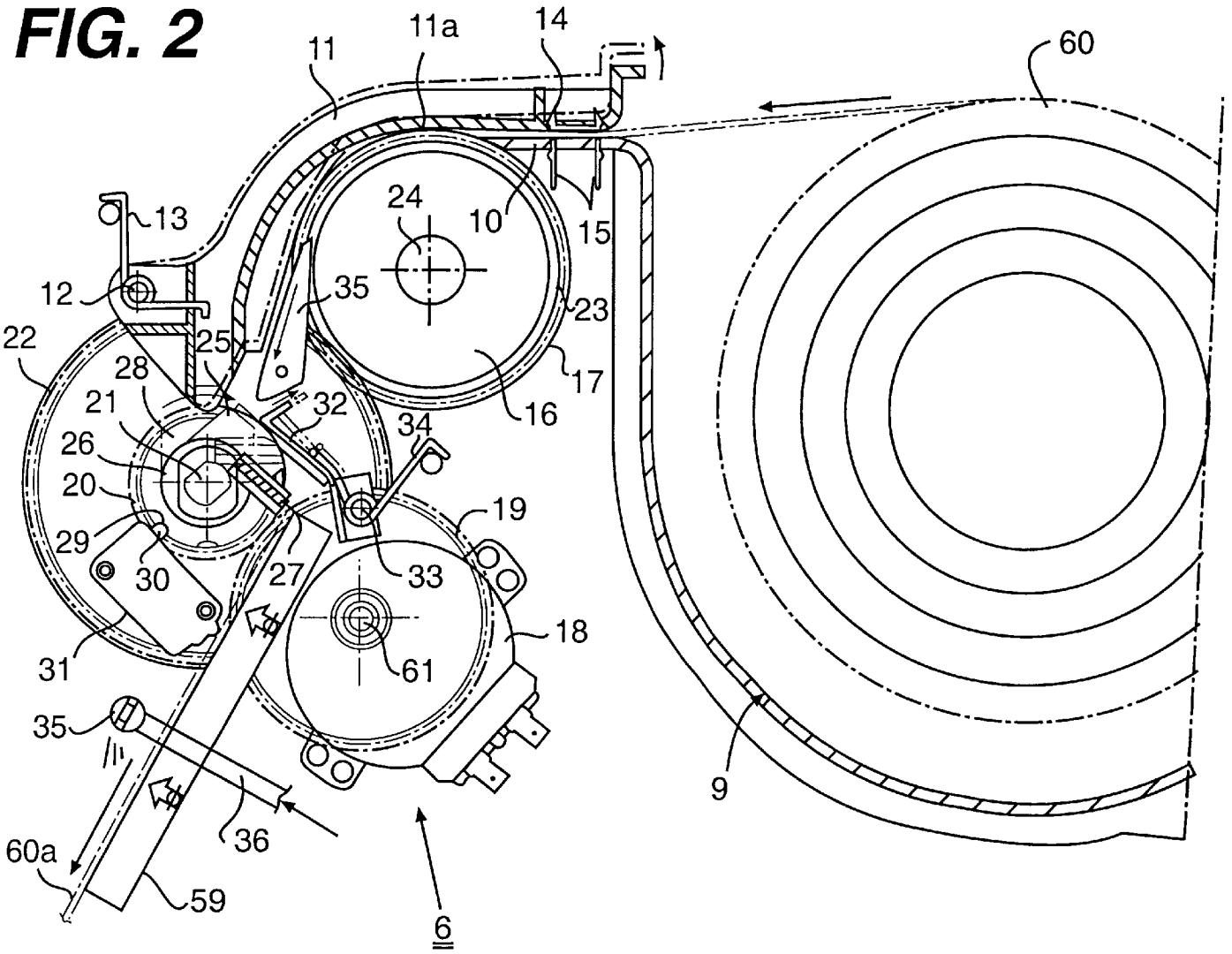
FIG. 2 is a top view of a cutting member of the automatic wet towel supplying apparatus according to the present invention containing cut away portions in order to illustrate the construction of the cutting member of the apparatus of the present invention.

As shown in FIG. 2, the cutting member 6 includes a guide plate 10 extending from a roll casing 9 of the dry cotton cloth chamber 5 and containing a clamping guide 11 disposed on one side thereof by a first shaft pin 12 for angularly moving and selectively contacting to the top and one end of the guide plate 10. The clamping guide 11 is supported resiliently toward the guide plate 10 by a first spring 13 and a first support 13'. The guide plate 10 and the clamping guide 11 have a contacting terminal 15 and a connecting terminal 14, respectively, for sensing the entry of the dry cotton cloth 60 from the dry cotton cloth roll 60'. At this time, these connecting and contacting terminals 14 and 15 are located on both contacting points of the clamping guide 11 and the guide plate 10.

The clamping guide 11 has a round portion 11*a* for contacting a loading roller 16. The loading roller 16 includes a rubber belt 17 disposed on a circumference of the loading roller 16 for preventing the dry cotton cloth 60 from sliding. A rubber coating layer (not shown) can be substituted for the rubber belt 17.

A driving motor 18 is connected to an electric source (not shown) and is provided with a driving shaft 61 of a coaxial driving gear 19 which is geared with a first driven gear 20. The driven gear 20 has a first driven shaft 21 which provides a coaxial connecting gear 22 in gearing relationship with a second driven gear 23. The second driven gear 23 is provided within a second driven shaft 24 of the loading roller 16. The first driven shaft 21 is provided with a coaxial cutter combining bracket 26 having a projected cam 25 The cutter combining bracket 26 is provided with a rotary cutter 27 attached thereto in the length direction and in a slant state. Also, the cutter combining bracket 26 is provided with a flange which has a concave surface 29. A switching button 30 of a microswitch 31 is disposed adjacent to the cutter combining bracket 26 for selectively entering into the concave 29 of the cutter combining bracket 26 so as to be in an OFF-position.

The rotary cutter 27 and a fixed cutter 32 cut the dry cotton cloth 60 together and contact operatively with each other. Only the fixed cutter 32 can be angularly moved by the cam 25 of the cutter combining bracket 26 since the fixed cutter 32 is attached to a second shaft pin 33 and resiliently supported by a second spring 34 as shown in FIG. 2.

Figure 3:
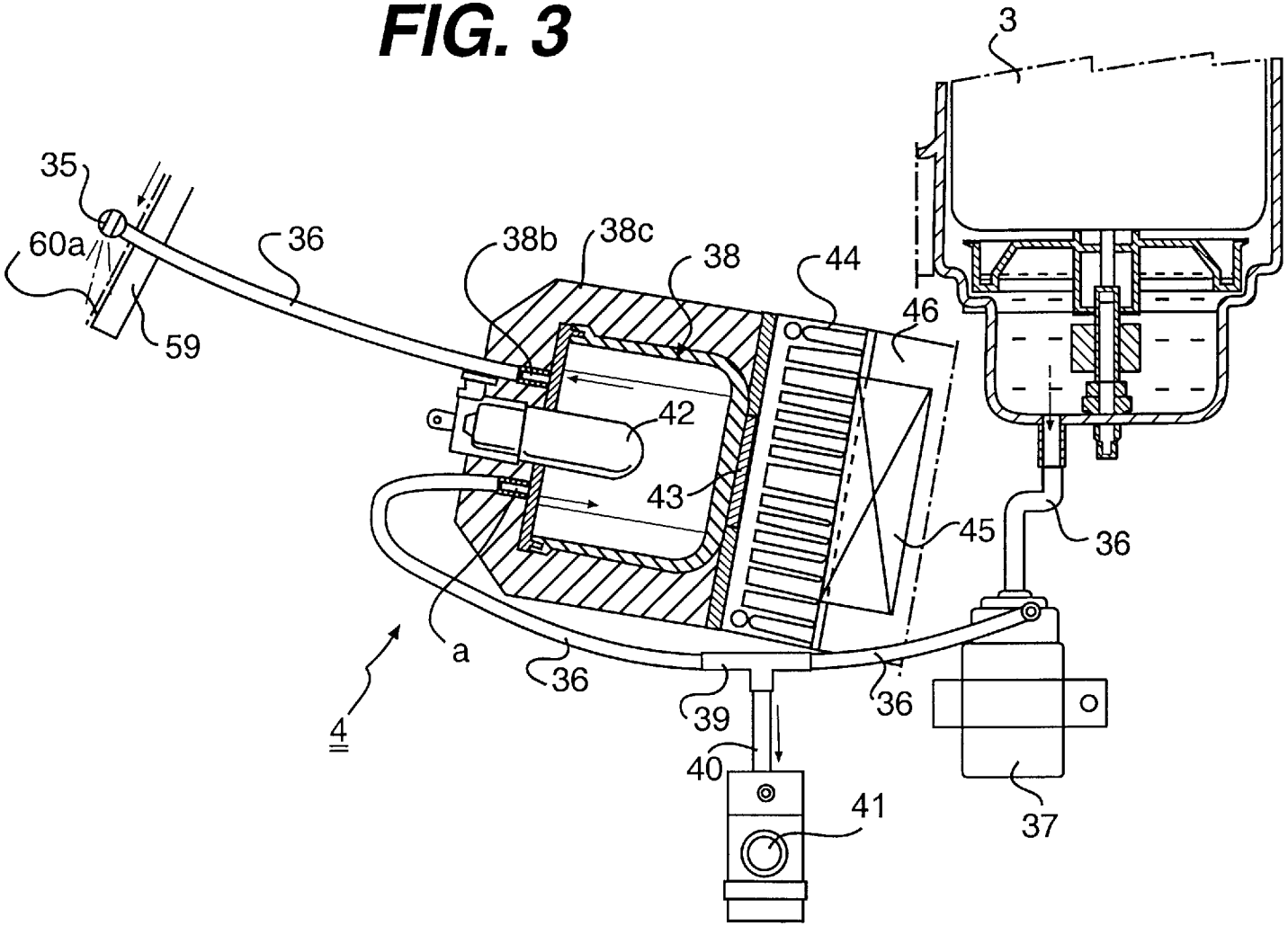
FIG. 3 is a top view of a spraying member of the automatic wet towel supplying apparatus according to the present invention containing cut away portions in order to illustrate the construction of the spraying member of the apparatus of the present invention.

As shown in FIG. 3, the spraying member includes a water pump 37 for sending the water in the water holding tank 3 to a nozzle through a plurality of supply hoses 36. At normal times, an auxiliary water tank stores water from the water holding tank 3 through an inlet opening 38*a*. A T-shaped manifold 39 is disposed between the supply hoses 36 which are disposed between the water pump 37 and the auxiliary water tank 38. The manifold 39 is connected to a drain valve 41 through an outlet hose 40. The manifold 39 is disposed on the lowest area relative to the supply hoses 36. The manifold 39 can be a composite structure of the drain valve 41 (not shown).

The auxiliary water tank 38 can be optionally located within the housing 2. However, the auxiliary water tank 38 has to be located lower relative to the water holding tank 3 for completely filling the auxiliary water tank in order to perform sterilization and cooling or warming processes of the water in the auxiliary water tank 38. The auxiliary water tank 38 includes a ultraviolet ray lamp 42 secured on one side thereof, a thermoelectric module (hereinafter "TEM" element) 43 for cooling or warming the water, and a radiator 44 disposed on the outside of the TEM element 43 for radiating heat. The radiator 44 is provided with a cooling fan 45 mounted on a front surface thereof and a vapor plate 46 attached to a front side thereof for improving the cooling effect.

Also, the auxiliary water tank 38 includes an outlet opening 38*b* for discharging the sterilized water in the auxiliary water tank 38 to the nozzle 35 through the supply hose 36 and an insulating material 38*c* for enveloping the auxiliary water tank 38 so as to prevent frost forming thereon and improving the cooling or warming effect. Accordingly, with the spraying member, a plurality of towels 60*a* are produced.

Figure 4:
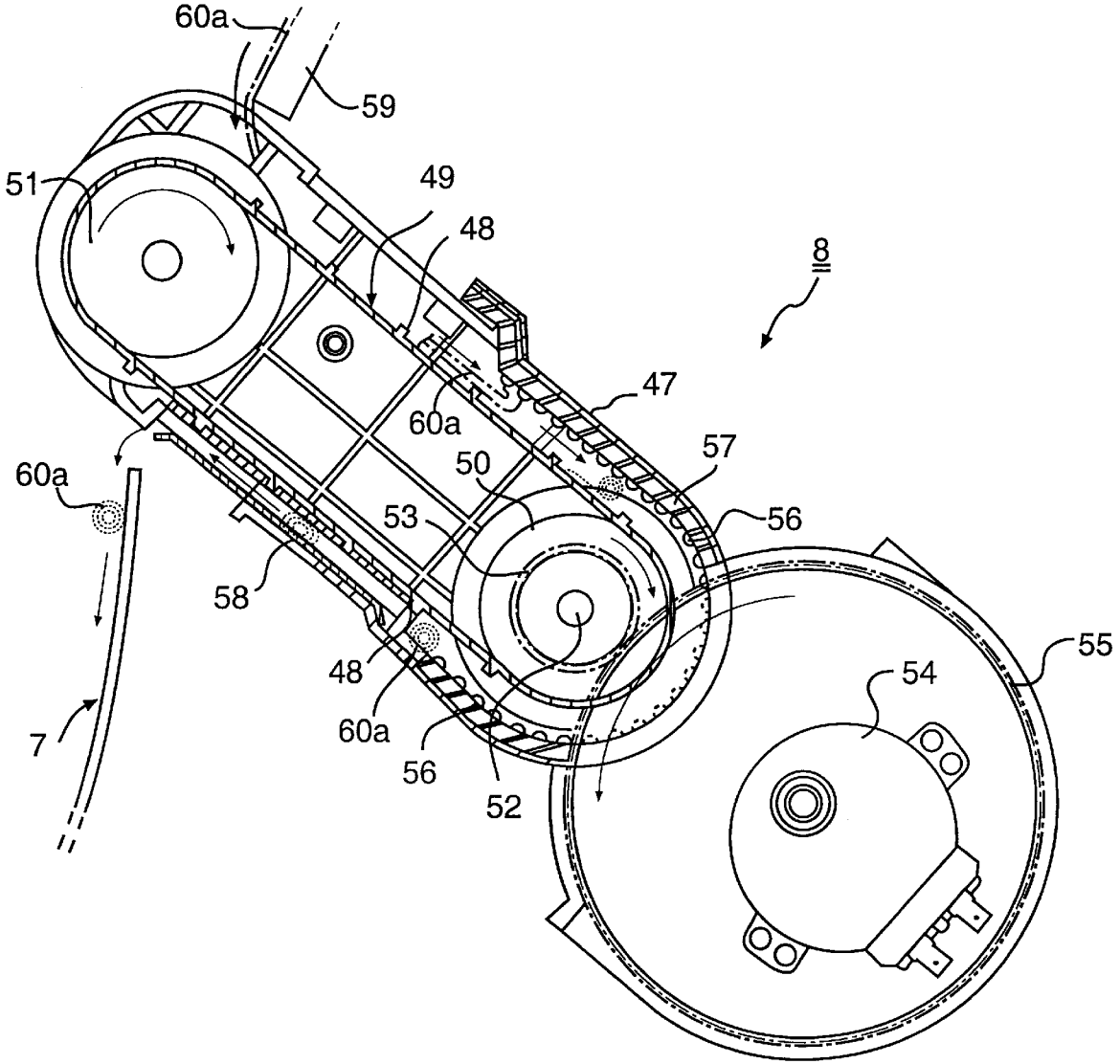
FIG. 4 is a top view of a wet towel winding member of the automatic wet towel supplying apparatus according to the present invention containing cut away portions in order to illustrate the construction of the wet towel winding member of the apparatus of the present invention.

As shown in FIG. 4, the wet towels winding member 8 includes a U-shaped winding unit casing 47 disposed within the housing 2. The winding unit casing 47 contains a conveyor belt 49 having a plurality of delivery lugs 48 for driving between a driving roller 50 and a driven roller 51. The third driving shaft 52 of the driving roller 50 is coaxially connected to a third driven gear 53 in gearing relationship with a second driving gear 55 which is coaxially connected to a fourth driving shaft of a second motor 54.

A space is disposed between the winding unit casing 47 and the conveyor belt 49 and the interior of the winding unit casing 47 has a plurality of small lugs 56 disposed on a pad 57 for matching with the plurality of delivery lugs 48. A wet towel outlet 62 has a compressing bracket 58 which provides a predetermined space between the conveyor belt 49 and the comprising bracket 58. The compressing bracket is also disposed parallel to the conveyor belt 49.

The automatic wet towel supplying apparatus 1 according to the present invention operates as follows. After the water holding tank is filled completely, with water and the dry cotton cloth chamber 5 receives the dry cotton cloth 60, one end of the dry cotton cloth 60 is clamped between the clamping guide 11 and the guide plate 10 of one end of the roll casing 9. Thereafter, the user operates a selecting operation switch (not shown) in accordance with a desired number of the wet towels 60*a*. Therefore, the number of rotations of the first driving motor 18 can be automatically controlled to produce the requested number of the wet towels 60*a*.

In order to explain in detail the operation of the automatic wet towel supplying apparatus according to the present invention, the following example describes one wet towel

60*a* to be produced. When the selecting operation switch is in an ON-position, the first driving motor is in an ON-position. Therefore, the first driving gear 19 operates, so that the first driven gear 20 operates and the coaxial connecting gear 22 operates. At this time, the second driven gear 23 of the second driven shaft 24 in gearing relationship with the connecting gear 22 operates too, so that the loading roller 16 rotates.

Upon rotating the loading roller 16, the dry cotton cloth 60 present between the loading roller 16 and the clamping guide 11 is loaded into the cutting member 6. When the dry cotton cloth 60 moves to a position near to the cutting member 6, the projected cam 25 of the cutter combining bracket 26 pushes the low end portion of the clamping guide 11 and rotates. At this time, the dry cotton cloth 60 stops temporarily since the clamping guide 11 moves up to a position of the first shaft pin 12 where the clamping guide is biased by the first spring 13. And simultaneously, upon activation of the rotary cutter 27 and the fixed cutter 32, the dry cotton cloth 60 disposed between both cutters 27 and 32 is cut completely.

When the cutting step finishes, the cam 25 is separated from the low end portion of the clamping guide 11. Therefore, the clamping guide 11 is returned to smoothly contact the loading roller 16 by the biasing force of the first spring 13. Accordingly, the dry cotton cloth 60 is loading again between the clamping guide 11 and the loading roller 16. If a surplus load between the rotary cutter 20 and the fixed cutter 32 is generated, the fixed cutter 32 is temporarily moved through the second shaft pin 33 and the second spring 34 so that a number of problems such as degradation of the cutters 27 and 32, and substandard cut products can be eliminated.

If the user wants to produce just one wet towel, the first driving motor is controlled by engaging the switching button 30 of the microswitch 31 with the concave surface 29 on the flange 28 of the cutter compressing bracket 26 or by disengaging the switching button 30 from the concave surface 29. The first driving motor 18 is in a ON-position during engagement of the concave surface 29 but is in an OFF-position when the concave surface 29 is not engaged by the button 30 due to rotation of the first driven shaft 21.

When driving motor 18 is in an ON-position, the water pump 37 of the spraying member 4 operates and the dry cotton cloth 60 is sprayed by the nozzle with a certain amount of water. After a certain time passes, the first driven shaft 21 rotates once. At this time, the switching button disengages with the concave surface 29 again and the first driving motor 18 is in an OFF-position automatically.

When the dry cotton cloth 60' in the dry cotton chamber 5 becomes exhausted, the clamping guide 11 moves down, so that the connecting terminal 14 contacts with the contacting terminal 15. Therefore, the cutting member 6 stops operating temporarily and this can be displayed to the user by a signal lamp or an alarm (not shown).

As shown in FIG. 3, in fact, the cut dry cotton cloth 60 moves down through a towel loading guide 59 and is dampened by water sprayed through the nozzle 35, so that the dry towel 60 changes to the wet towel 60*a*. At this time, the water is already sterilized, and the cold or hot water can be selectively supplied to the nozzle 35 from the auxiliary water tank 38.

The water in the auxiliary water tank 38 is always sterilized through the ultraviolet lamp 42 and can be cooled or warmed through the TEM element 43. Heat present in the water which is transmitted to the radiator 44 can be conducted, and discharged and ventilated by the cooling fan 45. Also, since the vapor plate covers the front surface of the radiator 44, the operation of the cooling fan 45 is more efficient.

If the user wants to clean the supply hoses 35, the drain valve is placed in an open position. Therefore, all waste materials in the supply hose 36 are discharged and drained. Thus, the hoses 35 can be simply cleaned.

As shown in FIG. 4, the wet towel 60*a* is delivered to the wet towel winding members through the towel loading guide 59. Thereafter, the wet towel 60*a* falls down to the upper portion of the conveyor belt 49 and is delivered into the interior of the winding unit casing 47 by rotation of a driving roller 50 and a driven roller 51. The driving roller 50 is coaxially connected to a third driven gear 53 which is geared with a second driving gear 55 which is coaxially connected to a second driving motor 54 connected to the electric source (not shown). At this time, the plurality of small lugs 56 on the pad 57 obstructs the entry of the wet towel 60*a*. Therefore, the wet towel 60*a* is rolled and the rolled wet towel 60*a* is maintained in a rolled state since the rolled wet towel 60*a* is delivered by force through the conveyor belt 49. Also, when the rolled wet towel 60*a* pushed by the compressing bracket 58, surplus moisture discharges and the wet towel is uniformly dampened. Finally, the wet towel 60*a* produced by the above processing steps is supplied to the user through the wet towel outlet 62 and the outlet member of 7.

The automatic wet towel supplying apparatus 1 according to the present invention has the following advantages:

(1) the dry cotton cloth can be precisely cut by the rotary cutter 20 and the fixed cutter 32;

(2) since the cutting and the loading of the dry cotton cloth 60 stops temporarily, entanglement of the dry cotton cloth 60 and substandard products are prevented;

(3) when the stored dry cotton cloth roll 60' becomes exhausted, it is easy to detect this problem by the connecting and contacting terminals 14 and 15;

(4) it is very easy to clean the supply hoses 36 through opening the drain valve 41;

(5) the water in the auxiliary water tank 38 which is to be sprayed to the dry towel 60 for converting it to the wet towel 60*a* is sterilized by the ultraviolet lamp 42 which eliminates any colon bacillus;

(6) the device permits the user to selectively choose either cold or hot water to be sprayed to the dry towel 60 by operating the TEM element 43;

(7) the device provides a wet towel 60*a* which is easy to grasp by making it through the plurality of small lugs 56 on the pad 57; and (8) moisture is uniformly distributed in the wet towel 60*a* by the compressing bracket 58 of the wet towel winding member 8.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic wet towel supplying apparatus comprising:

a cutting member disposed in a housing, said cutting member including:

a first driving motor connected to a first driving gear;

a first driven gear in gearing relationship with said first driving gear and having a first driven shaft, said driven shaft is coaxially connected to a cutter combining bracket and to a connecting gear;

a rotary cutter disposed on said cutter combining bracket in a length direction;

a fixed cutter for precisely cutting a dry-cotton cloth with said fixed cutter;

a second driven gear in gearing relationship with said connecting gear;

a clamping guide for selectively contacting with said second driven gear so as to clamp said dry cotton cloth from a cotton cloth roll disposed within a roll casing;

a spraying member disposed in said housing, said spraying member including:

a water holding tank communicated with a water pump;

an auxiliary water tank communicated with said water holding tank and disposed under said water holding tank, said auxiliary water tank containing an ultraviolet lamp for sterilizing water and a thermoelectric module element for cooling and warming water;

a nozzle communicated with said auxiliary water tank for spraying water to the dry towel delivered from said cutting member;

a towel winding member disposed in said housing, said towel winding member including:

a second driving gear connected to a third driven gear;

a conveyor belt having a plurality of lugs and rotated by a driven roller and said third driven gear in gearing relationship with said second driving gear; and a towel winding unit casing having a plurality of small lugs for making a rolled wet towel, whereby the dry cotton cloth is loaded between the clamping guide and a loading roller and is cut by the rotary and fixed cutters of the cutting member, the dry towel is sprayed by the spraying member, and is rolled and is uniformly dampened to produce a wet towel.

2. The automatic wet towel supplying apparatus of claim 1, wherein said clamping guide and a guideplate include a connecting terminal and a contacting terminal for sensing the entry of the dry cotton cloth between said clamping guide and said loading roller.

3. The automatic wet towel supplying apparatus of claim 1, wherein said clamping wet is biased by a first spring about a first shaft pin for angularly moving said clamping guide up by a cam disposed on a flange of the first driven gear so as to stop temporarily the entry of the dry cotton cloth while the cutters are cutting the dry cotton cloth so that cutting precision is increased.

4. The automatic wet towel supplying apparatus of claim 1, wherein said fixed cutter can be smoothly and angularly moved by the biasing force of second spring, and a second shaft pin for preventing the dry cotton cloth from becoming entangled.

5. The automatic wet towel supplying apparatus of claim 1, wherein said auxiliary water tank further contains a radiator, a vapor plate, a cooling fan, and envelope for improving heat transfer.

6. The automatic wet towel supplying apparatus of claim 1, wherein a drain valve is disposed between said water pump and said auxiliary water tank; said drain valve, water pump, auxiliary water tank, water holding tank and nozzle are connected to each other through supply hoses, said supply hoses being cleaned by operating the drain valve.

7. The automatic wet towel supplying apparatus of claim 1, wherein said plurality of small lugs are disposed on a pad attached to said winding unit casing.

8. The automatic wet towel supplying apparatus of claim 1, wherein said towel winding unit casing is provided with a compressing bracket for uniformly dampening moisture in the wet towel.

9. The automatic wet towel supplying apparatus of claim 1, wherein said first driven gear contains a concave surface for engaging with a switching button of a microswitch so as to be in an ON-position to activate the first driving motor.

* * * * *